US006698694B2

(12) United States Patent
Kao

(10) Patent No.: US 6,698,694 B2
(45) Date of Patent: Mar. 2, 2004

(54) TUBE POSITION LIMITER

(76) Inventor: Wen Li Kao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/421,030

(22) Filed: Apr. 24, 2003

(65) Prior Publication Data

US 2003/0205646 A1 Nov. 6, 2003

(30) Foreign Application Priority Data

May 2, 2002 (TW) ..... 91206284 U

(51) Int. Cl.[7] ..... F16L 3/00
(52) U.S. Cl. ..... 248/49
(58) Field of Search ..... 248/75, 49, 76, 248/79, 80, 90, 91, 92, 93, 309.1, 314

(56) References Cited

U.S. PATENT DOCUMENTS 5,390,695 A * 2/1995 Howard ..... 137/355.27

* cited by examiner

*Primary Examiner*—Ramon O. Ramirez
*Assistant Examiner*—Kofi Schulterbrandt

(57) ABSTRACT

A tube position limiter comprises a supporting frame for locking to a wall and a positioning cylinder for receiving a tube. A center of the supporting frame is formed with a receiving hole for receiving the positioning cylinder. A top of the positioning cylinder is formed with a curl lip for receiving the tube. The positioning cylinder is placed into the receiving hole so that the curl lip of the positioning cylinder exactly places on the supporting frame. The helical wound tube is placed in a bottom of the positioning cylinder. A water inlet end of the tube exactly protrudes from a via hole at a bottom of the positioning cylinder. In use of the tube, the curl lip of the positioning cylinder has a round opening so that the tube is taken out easily. When it is desired to wind the tube, the tube is wound easily and conveniently.

4 Claims, 7 Drawing Sheets

TUBE POSITION LIMITER

FIELD OF THE INVENTION

The present invention relates to tube position limiters, and particularly to a tube position limiter wherein a curl lip of the positioning cylinder has a round opening so that the tube can be taken out easily. When it is desired to wind the tube, the tube is wound easily and conveniently.

BACKGROUND OF THE INVENTION

In the present invention, the tube position limiter serves to contain a long water tube which can be connected to a faucet. By the tube position limiter of the present invention, the tube can be stored easily and placed in order.

In the prior art tube position limiter, referring to FIG. 1, a positioning post 5 is locked to a wall. A tube 3 is arranged on the post 5. The post 5 is arranged vertically. A bottom of the stud has an L shape locking piece 51 which is locked to a wall by studs P so that the tube is wound around the post 5.

However this prior art is not an ideal device. The tube will deform with it is used for a longer time. As a result, the tube can not be easily wound around the post. Moreover, since the post is made of metal, it is heavy and thus can not be transferred easily. Thereby, the tube wound around the post exposes out and therefore it is easily damaged due to bad whether.

SUMMARY OF THE INVENTION

Accordingly, the primary object of the present invention is to provide a tube position limiter which comprises a supporting frame for locking to a wall and a positioning cylinder for receiving a tube. A center of the supporting frame is formed with a receiving hole for receiving the positioning cylinder. A lateral side of the supporting frame is bent to form a vertical surface. The vertical surface of supporting frame is locked to a wall by studs. A top of the positioning cylinder is formed with a curl lip for receiving the tube. The positioning cylinder is placed into the receiving hole at the center of the supporting frame so that the curl lip of the positioning cylinder exactly places on the supporting frame. The helical wound tube is placed in a bottom of the positioning cylinder. A water inlet end of the tube exactly protrudes from a via hole at a bottom of the positioning cylinder. In use of the tube, the curl lip of the positioning cylinder has a round opening so that the tube is taken out easily without being buckled; when it is desired to wind the tube, the tube is wound easily and conveniently.

The various objects and advantages of the present invention will be more readily understood from the following detailed description when read in conjunction with the appended drawing

DETAILED DESCRIPTION OF THE PREFERRED EMBODIMENTS

Figure 1:
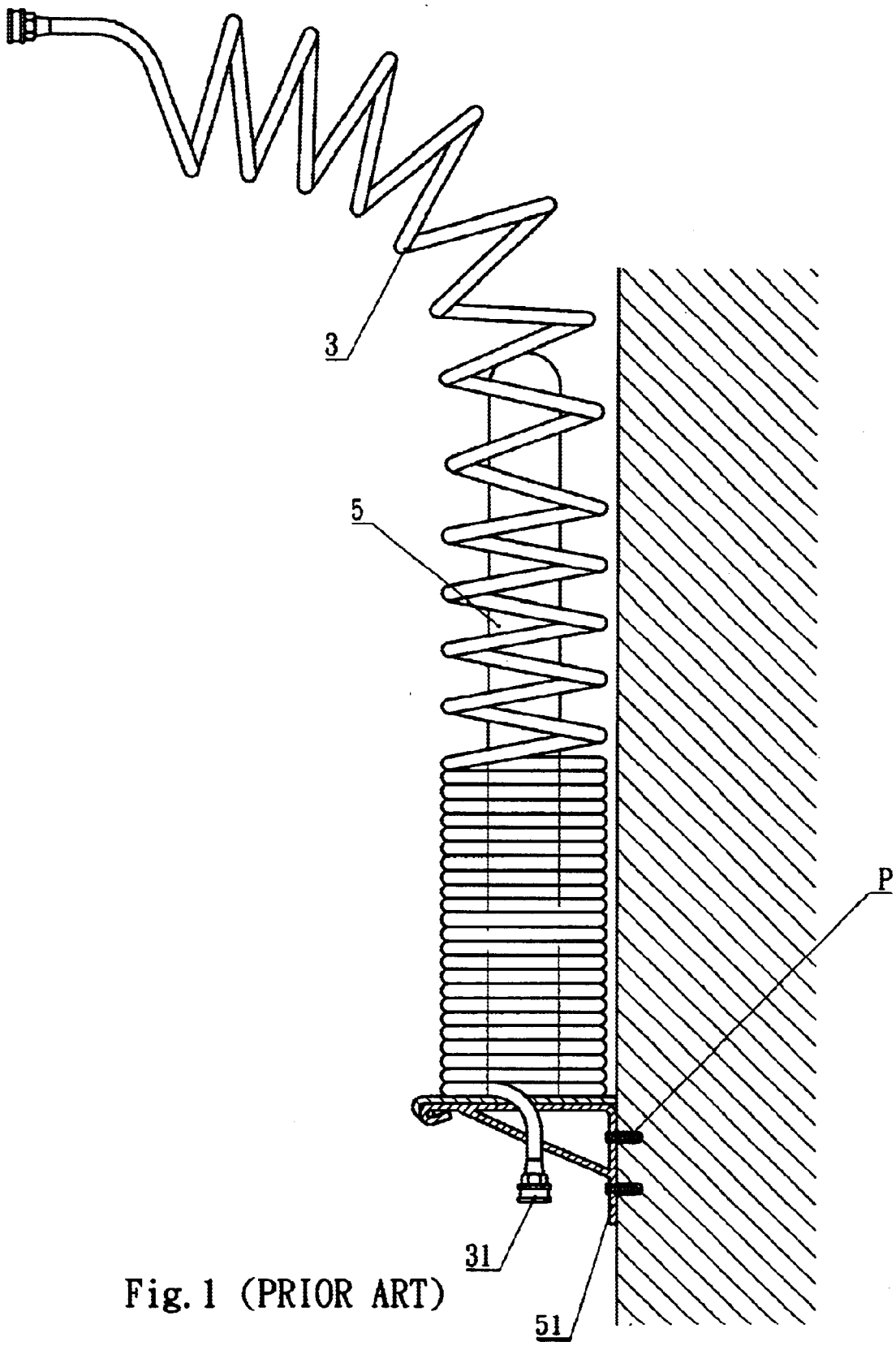
Fig. 1 (PRIOR ART)
FIG. 1 shows the operation of the prior art tube position limiter.
Figure 2:
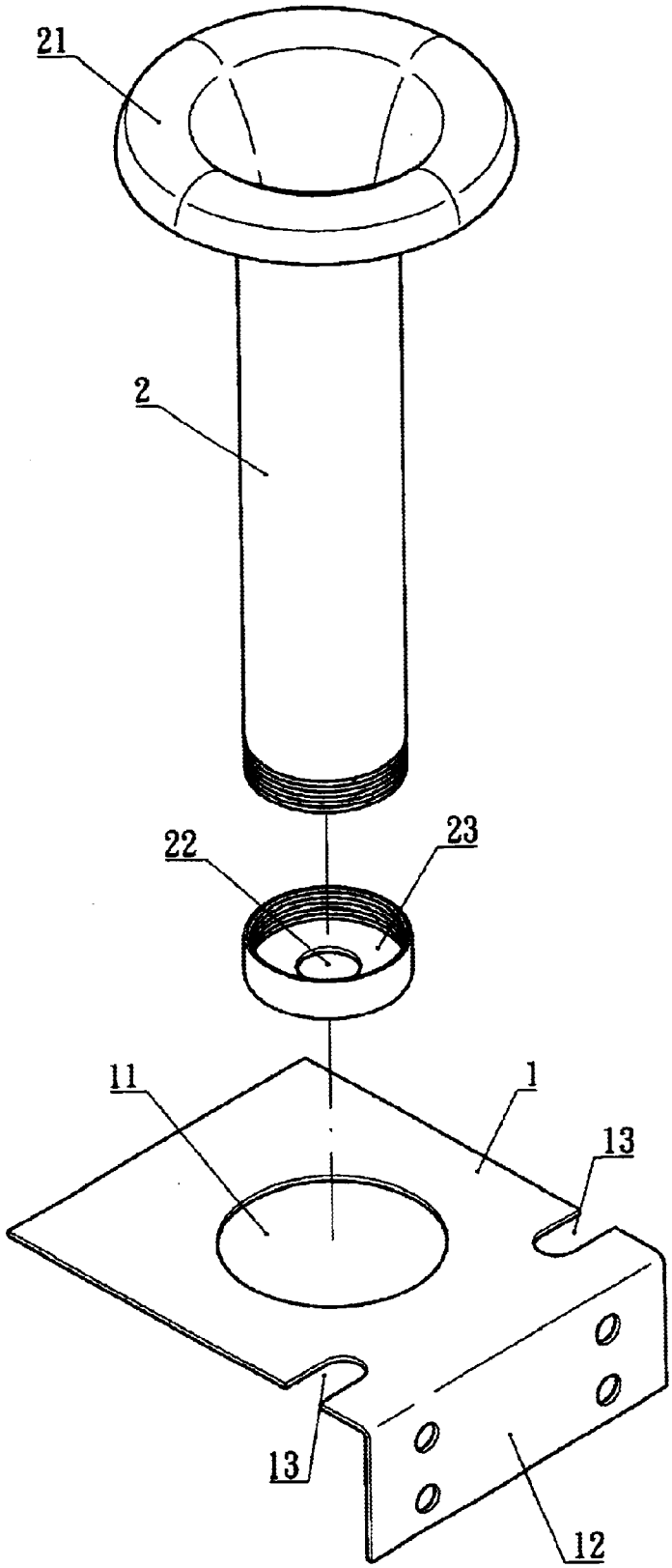
FIG. 2 is an exploded perspective view of the present invention.
Figure 3:
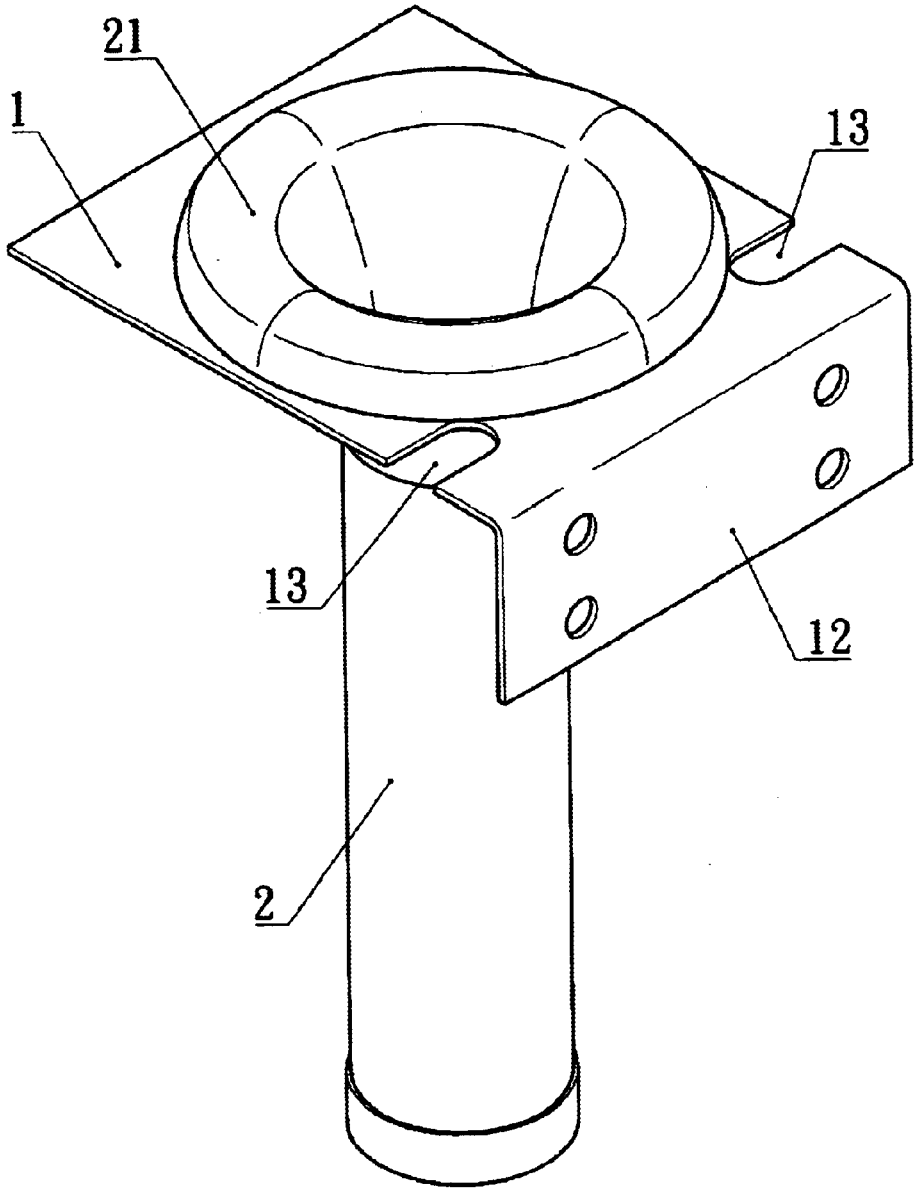
FIG. 3 is a perspective view of, the tube position limiter of the present invention.

Referring to FIGS. 2 and 3, the tube position limiter of the present invention is illustrated. The tube position limiter includes a supporting frame 1 for locking to a wall and a positioning cylinder 2 for receiving a tube 3.

A center of the supporting frame 1 is formed with a receiving hole 11 for being inserted by the positioning cylinder 2. A lateral side of the supporting frame 1 is bent to form a vertical surface 12. The vertical surface 12 of supporting frame 1 is locked to a wall by studs. Each of two sides of the supporting frame 1 is formed with a groove 13 for buckling a nozzle of a tube 3 so as to position the nozzle.

A top of the positioning cylinder 2 is formed with a curl lip 21.for receiving the tube 3. The positioning cylinder 2 is placed into the receiving hole 11 at the center of the supporting frame 1 so that the curl lip 21 of the positioning cylinder 2 exactly places on the supporting frame 1. The helical wound tube 3 is placed in a bottom of the positioning cylinder 2. A water inlet end 31 of the tube 3 exactly protrudes from a via hole 22 at a bottom of the positioning cylinder 2. An inward cambered sheet 23 is formed around the via hole 22 so as to enhance the structure.

Figure 4:
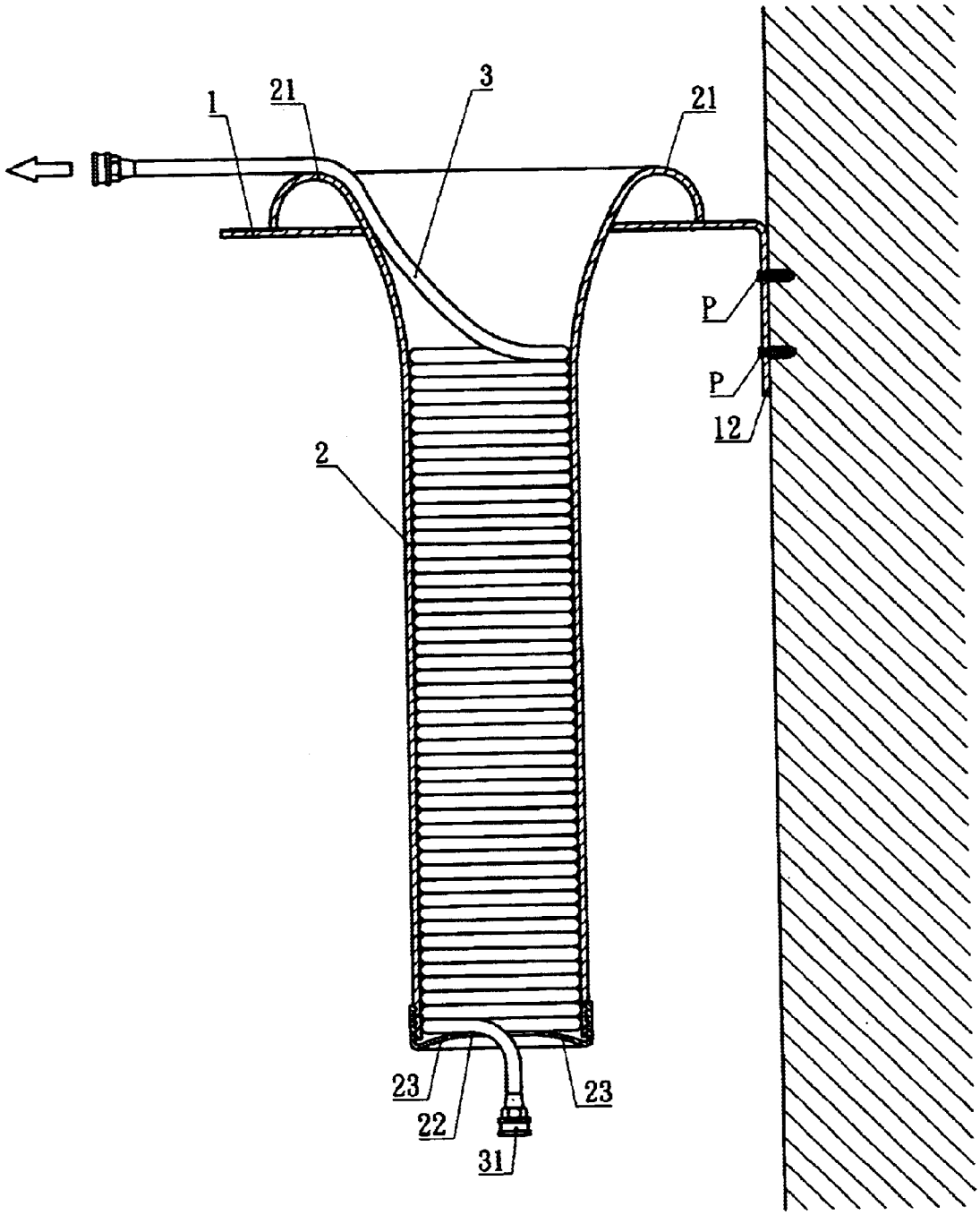
FIG. 4 shows the operation of the present invention.
Figure 5:
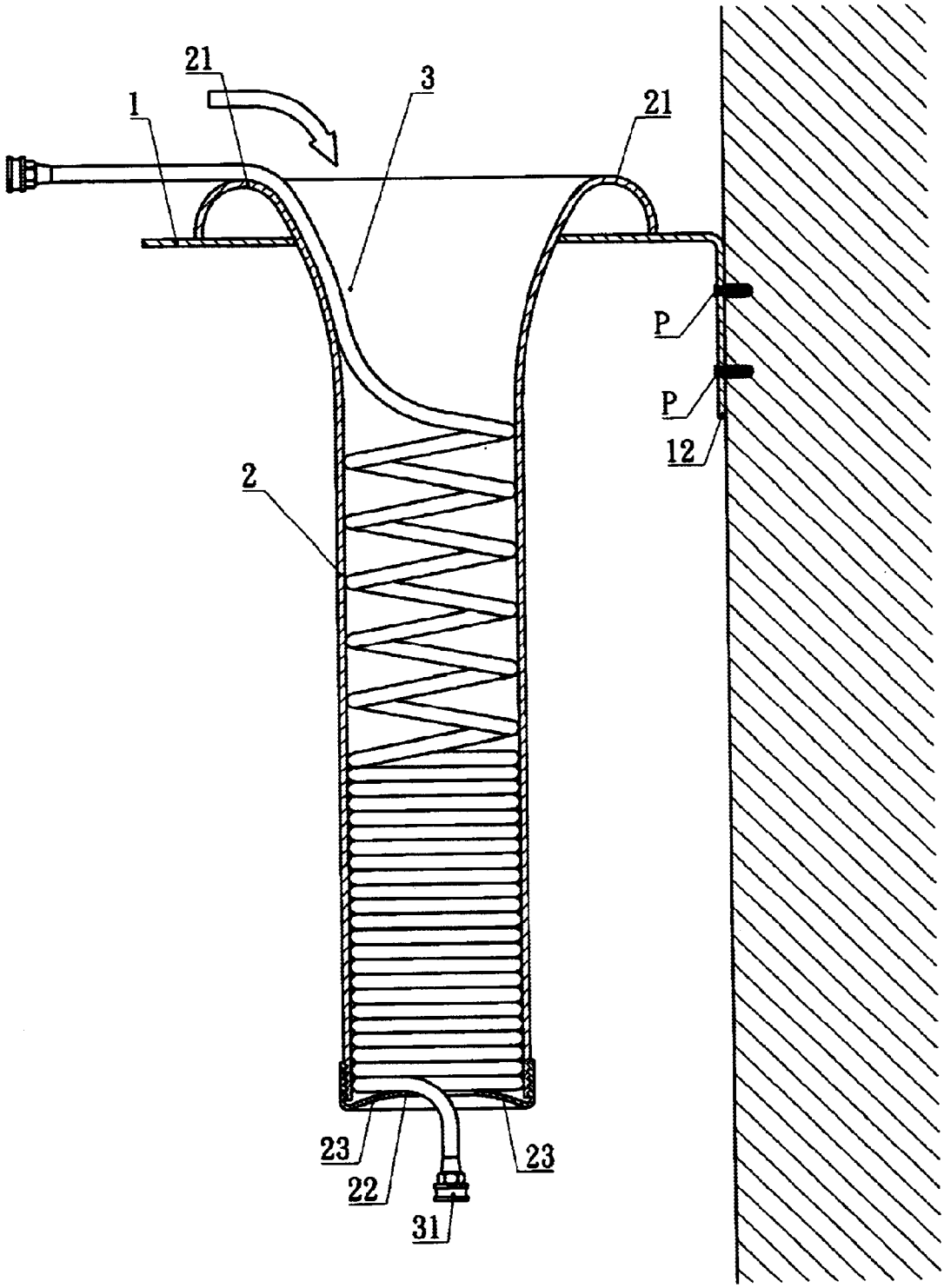
FIG. 5 shows another operation of the present invention.

With reference to FIGS. 4 and 5, the operation of the present invention will be described here. In use of the tube 3, the curl lip 21 of the positioning cylinder 2 has a round opening so that the tube 3 can be taken out easily without being buckled. When it is desired to wind the tube 3, the tube 3 can still be wound easily and conveniently.

Moreover, since the positioning cylinder 2 is placed in the receiving hole 11 of the supporting frame 1, it is a detachable structure. Thereby, when the tube 3 is not used, the tube 3 and the positioning cylinder 2 can be stored for preventing from damage due to bad whether.

Figure 6:
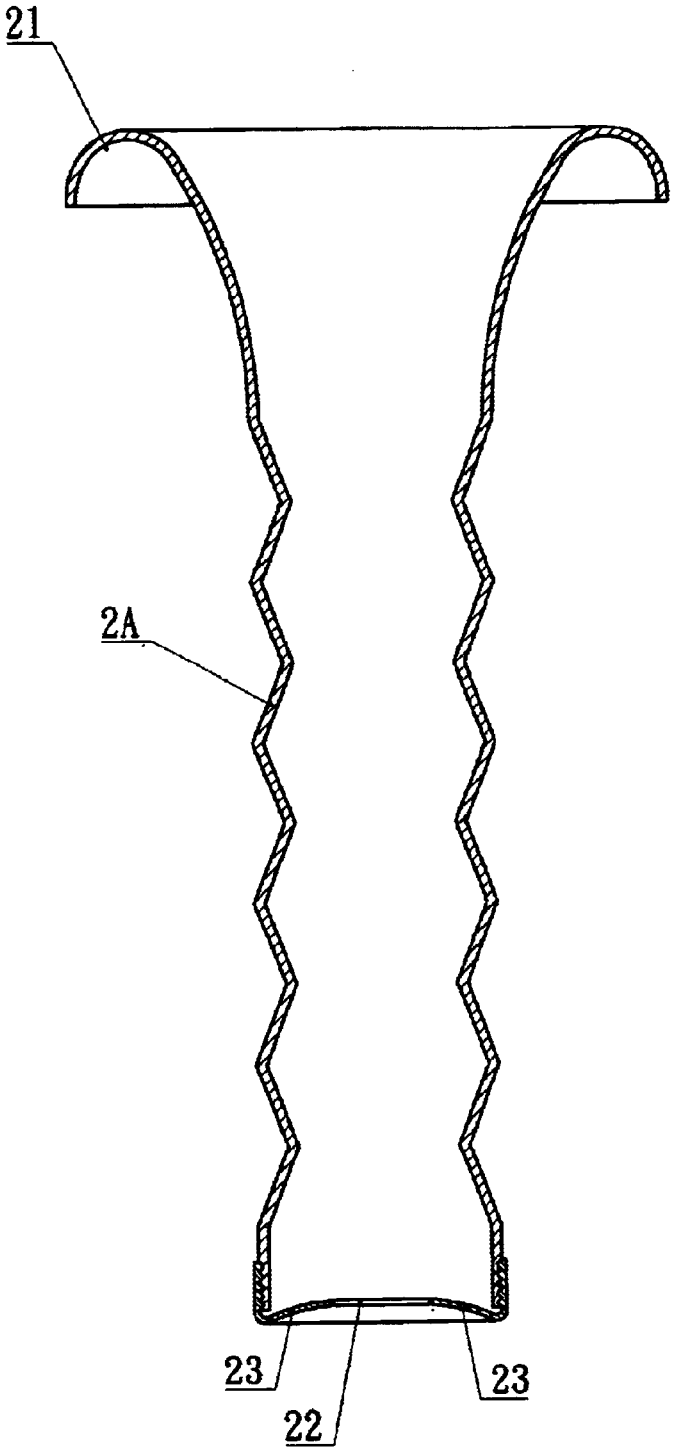
FIGS. 6 and 7 show another embodiments of the present invention.
Figure 7:
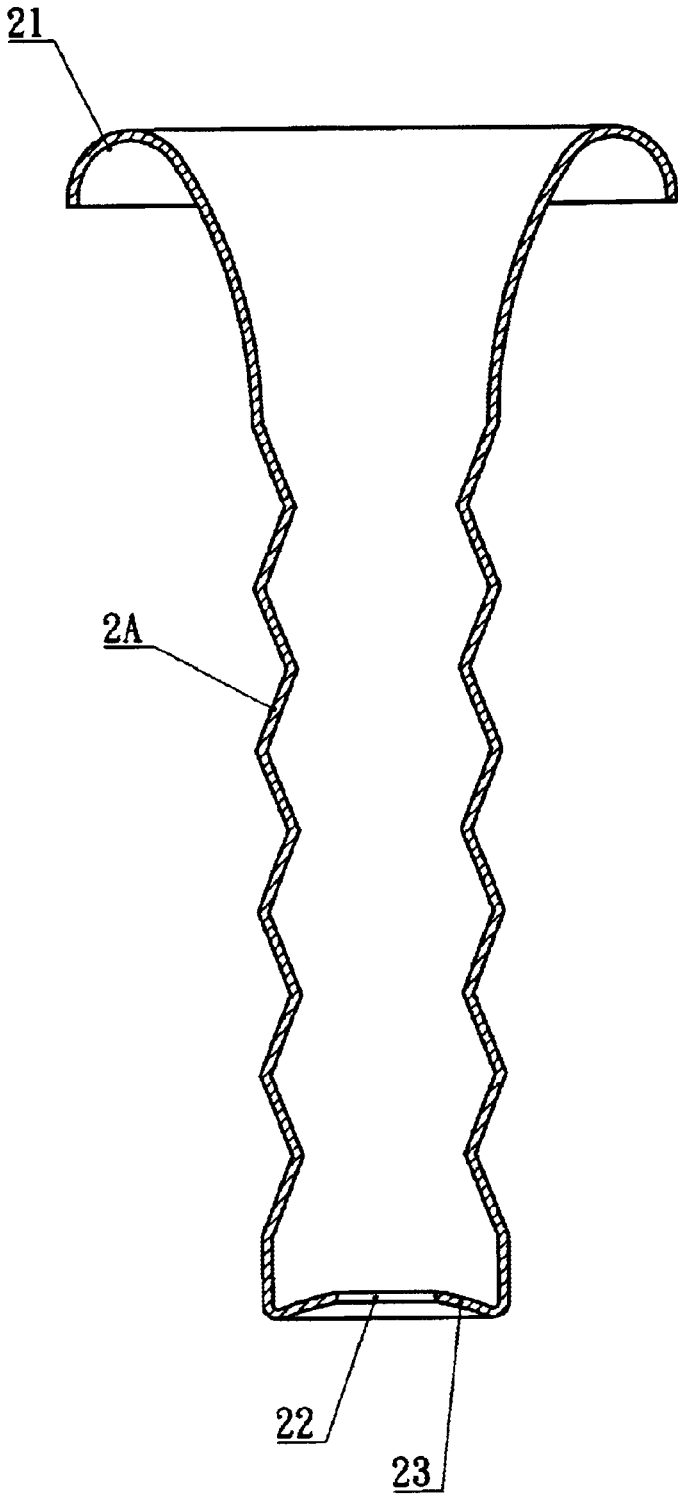

With reference to FIG. 6, another embodiment of the present invention is illustrated. The positioning cylinder 2 of the present invention is formed as a snake shape tube so that the positioning cylinder 2 is telescopic for use or storage.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A tube position limiter comprising a supporting frame for locking to a wall and a positioning cylinder for receiving a tube; wherein a center of the supporting frame being formed with a receiving hole for receiving the positioning cylinder; a lateral side of the supporting frame is bent to form a vertical surface; the vertical surface of supporting frame is locked to a wall by studs;

a top of the positioning cylinder is formed with a curl lip for receiving the tube; the positioning cylinder is placed into the receiving hole at the center of the supporting frame so that the curl lip the positioning cylinder exactly places on the supporting frame; the helical wound tube is placed in a bottom of the positioning cylinder; a water inlet end of the tube exactly protrudes from a via hole at a bottom of the positioning cylinder;

wherein in use of the tube, the curl lip of the positioning cylinder has a round opening so that the tube is taken out easily without being buckled; when it is desired to wind the tube, the tube is wound easily and conveniently.

2. The tube position limiter as claimed in claim 1, wherein each of two sides of the supporting frame is formed with a groove for buckling a nozzle of a tube so as to position the nozzle.

3. The tube position limiter as claimed in claim 1, wherein an inward cambered sheet is formed around the via hole so as to enhance the structure.

4. The tube position limiter as claimed in claim 1, wherein the positioning cylinder is formed as a snake shape tube so that the positioning cylinder is telescopic for use or storage.

* * * * *